US009653192B2

(12) United States Patent
Ho et al.

(10) Patent No.: US 9,653,192 B2
(45) Date of Patent: May 16, 2017

(54) PTC COMPOSITION AND OVER-CURRENT PROTECTION DEVICE CONTAINING THE SAME

(71) Applicant: Polytronics Technology Corp., Hsinchu (TW)

(72) Inventors: Chien Cheng Ho, Taipei (TW); Tong Cheng Tsai, Tainan (TW); Kuo Chang Lo, New Taipei (TW); Yi An Sha, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 62 days.

(21) Appl. No.: 14/806,267

(22) Filed: Jul. 22, 2015

(65) Prior Publication Data

US 2016/0093414 A1 Mar. 31, 2016

(30) Foreign Application Priority Data

Sep. 29, 2014 (TW) ..... 103133760 A

(51) Int. Cl.

| | |
|---|---|
| ***H01C 7/10*** | (2006.01) |
| ***H01B 1/20*** | (2006.01) |
| ***H01C 7/02*** | (2006.01) |
| *H01C 7/00* | (2006.01) |

(52) U.S. Cl.

CPC ..... *H01B 1/20* (2013.01); *H01C 7/021* (2013.01); *H01C 7/028* (2013.01); *H01C 7/008* (2013.01)

(58) Field of Classification Search

CPC ..... H01C 7/008; H01C 7/021
USPC ..... 338/22 R, 13
See application file for complete search history.

(56) References Cited

U.S. PATENT DOCUMENTS

| | | | | |
|---|---|---|---|---|
| 8,525,636 | B1 * | 9/2013 | Sha | H01C 17/06526 338/22 R |
| 2009/0148657 | A1 | 6/2009 | Ihle et al. | |
| 2013/0200988 | A1 * | 8/2013 | Lo | H01C 7/13 338/22 R |
| 2014/0091896 | A1 * | 4/2014 | Wang | H01C 1/08 338/22 R |
| 2014/0146432 | A1 * | 5/2014 | Wang | H01C 7/027 361/93.7 |
| 2014/0306605 | A1 * | 10/2014 | Lo | H01C 7/028 315/71 |

FOREIGN PATENT DOCUMENTS

| | | |
|---|---|---|
| CN | 103258607 A | 8/2013 |
| CN | 103714924 A | 4/2014 |

* cited by examiner

*Primary Examiner* — Kyung Lee
(74) *Attorney, Agent, or Firm* — Muncy, Geissler, Olds & Lowe, P.C.

(57) ABSTRACT

A PTC composition comprises crystalline polymer and conductive filler. The conductive filler comprises tungsten carbide powder dispersed in the crystalline polymer, and the tungsten carbide powder comprises impurity of less than 7% by weight. The impurity comprises the materials other than tungsten monocarbide.

13 Claims, 5 Drawing Sheets

PTC COMPOSITION AND OVER-CURRENT PROTECTION DEVICE CONTAINING THE SAME

BACKGROUND OF THE INVENTION (1) Field of the Invention

The present application relates to a positive temperature coefficient (PTC) composition and an over-current protection device containing the same, and more particularly to a PTC composition having low volume resistivity and an over-current protection device containing the same.

(2) Description of the Related Art

Because the resistance of conductive composite materials having PTC characteristic is very sensitive to temperature variation, it can be used as the material for current sensing devices and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the crystalline polymer of the PTC conductive composite material will melt and expand to sever a lot of conductive paths and therefore the resistance instantaneously increases to a high resistance state (i.e., trip) to decrease the current.

The PTC conductive composite material usually comprises crystalline polymer and conductive filler. The conductive filler is dispersed in the crystalline polymer. The crystalline polymer may comprise polyolefin such as polyethylene, and the conductive filler usually comprise carbon black. In recent years, the conductive filler tends to the use of conductive ceramic, e.g., tungsten carbide, in place of the carbon black to attain low resistivity.

However, impurity may be generated in sintering process of tungsten carbide, resulting in high or unstable resistivity. As a result, the PTC conductive composite material using tungsten carbide is difficult to achieve ideally low resistivity.

SUMMARY OF THE INVENTION

In order to increase battery lifetime, an over-current protection device employed in a secondary battery has to perform good resistance repeatability after being tripped. The present application devises a PTC composition and an over-current protection device containing the same, in which the PTC composition uses crystalline polymer and high purity tungsten carbide filler dispersed therein to further decrease volume resistivity of the over-current protection device and obtain superior resistance repeatability.

In a first aspect of the present application, a PTC composition is devised, which comprises crystalline polymer and conductive filler. The conductive filler comprises tungsten carbide powder dispersed in the crystalline polymer, and the tungsten carbide powder comprises impurity of equal to or less than 7% by weight (≤7 wt %). The impurity comprises the materials other than molecular formula WC, i.e., tungsten monocarbide.

In an exemplary embodiment, the PTC composition exhibits a volume resistivity less than 0.4 Ω·cm.

In an exemplary embodiment, the tungsten carbide powder comprises 85-95 wt % of the PTC composition.

In an exemplary embodiment, the tungsten carbide powder comprises 91 wt % or more of the PTC composition, and the PTC composition has a volume resistivity equal to or less than 0.05 Ω·cm.

In an exemplary embodiment, the tungsten carbide powder comprises 93 wt % or more of the PTC composition, and the PTC composition has a volume resistivity equal to or less than 0.025 Ω·cm.

In an exemplary embodiment, the tungsten carbide powder comprises 94.5 wt % or more of the PTC composition, and the PTC composition has a volume resistivity equal to or less than 0.015 Ω·cm.

In an exemplary embodiment, the tungsten carbide powder having molecular formula WC is of hexagonal close-packed (HCP) structure.

In an exemplary embodiment, the impurity of the tungsten carbide powder comprises carbon, oxygen, tungsten oxide, tungsten, cobalt, nickel, chromium, molybdenum, iron, zirconium carbide, molybdenum carbide, tungsten carbide with molecular formula $W_2C$, tungsten carbide with molecular formula $WC_{1-x}$, or combinations thereof.

In an exemplary embodiment, the impurity $W_2C$ is less than 5 wt % of the tungsten carbide powder, and preferably less than 3 wt % of the tungsten carbide powder.

In an exemplary embodiment, the tungsten carbide powder has a particle size ranging from 0.01 μm to 100 μm, and preferably from 0.1 to 50 μm.

In an exemplary embodiment, the crystalline polymer may comprise high-density polyethylene, medium-density polyethylene, low-density polyethylene, polyvinyl wax, vinyl polymer, polypropylene, polyvinyl chlorine, polyvinyl fluoride, fluorinated polymer, or mixtures thereof.

In a second aspect of the present application, an over-current protection device comprises two conductive layers and a PTC material layer. The PTC material layer is laminated between the two conductive layers, and the PTC material layer comprises the aforesaid PTC composition. The conductive layers may be copper foils, nickel foils or nickel-plated copper foils.

Two metal electrode leads may be jointed to the two conductive layers of the over-current protection device by reflow or spot-welding process to form an assembly; for example, an axial-leaded, a radial-leaded, or a terminal device. The PTC composition also can be applied to a surface mountable device if desired.

BRIEF DESCRIPTION OF THE DRAWINGS

The present application will be described according to the appended drawings in which.

DETAILED DESCRIPTION OF THE INVENTION

Figure 1:
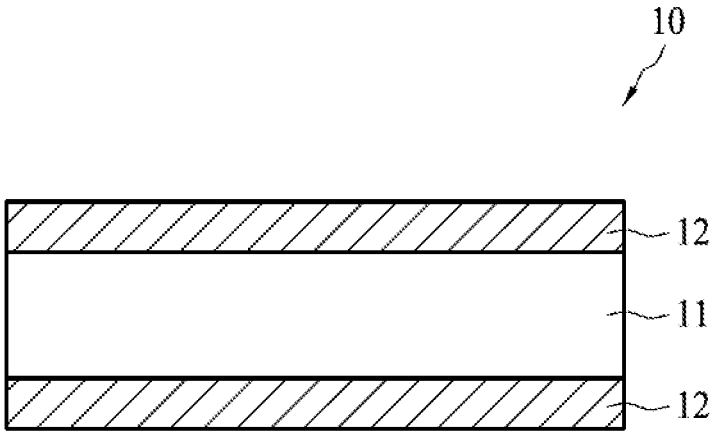
FIG. 1 shows an over-current protection device in accordance with an embodiment of the present application.

Tungsten carbide may be made through carbonization process in which tungsten and carbon such as graphite are put in an environment of hydrogen gas or vacuum at a temperature of 1400-2000° C. However, the product of tungsten carbide powder may contain various impurities, which may come from impurities in raw materials, the presence of minor oxygen in the environment of carbonization, the addition of binder such as cobalt or nickel in sintering.

Moreover, tungsten carbide may have impurities of molecular formula other than WC during sintering process. The reactions below indicate that impurities $W_2C$ and $WC_{1-x}$ may be formed.

$$WC+W \rightarrow W_2C$$

$$WC+W_2C \rightarrow WC_{1-x}$$

If oxygen is present in the environment, tungsten oxide ($WO_2$, $WO_3$) may be generated during sintering process and other impurities may be generated due to incomplete reaction of tungsten powder.

In summary, the impurities other than tungsten monocarbide, i.e., tungsten carbide of molecular formula WC, may comprise carbon (C), oxygen (O), tungsten oxide ($WO_2$), tungsten (W), cobalt (Co), nickel (Ni), chromium (Cr), molybdenum (Mo), iron (Fe), zirconium carbide (ZrC), molybdenum carbide (MoC), $W_2C$, $WC_{1-x}$, or the mixtures thereof. The impurity of the tungsten carbide powder used in the present application, i.e., the materials other than tungsten monocarbide, is equal to or less than 7 wt %. In other words, the tungsten carbide powder comprises tungsten monocarbide of 93 wt % or more. That is, the purity of tungsten carbide powder is equal to or greater than 93 wt %. Below are experiments showing that the volume resistivity of PTC composition can be lowered by 20-50% if the high purity tungsten carbide powder is applied to the PTC composition.

Tungsten monocarbide of HCP structure is used in the present application. The closed-pack structure constitutes more conductive paths and therefore is able to perform high conductivity and good resistance repeatability.

The PTC composition of the present application is exemplified below, including exemplary embodiments (Em 1 to Em 5) and comparative examples (Comp 1 to Comp 4).

The compositions of the PTC material layer containing crystalline polymer and conductive filler are shown in Table 1. In the exemplary embodiments, the crystalline polymer comprises high-density polyethylene (HDPE) and low-density polyethylene (LDPE), whereas the conductive filler is tungsten carbide powder which is dispersed in the crystalline polymer.

TABLE 1

| | Composition (wt %) | | | Purity of | |
|---|---|---|---|---|---|
| | HDPE | LDPE | Tungsten carbide | tungsten carbide | Resistivity (Ω · cm) |
| Em 1 | 9% | 0% | 91% | 93% | 0.05 |
| Em 2 | 6% | 0.80% | 93% | 95% | 0.025 |
| Em 3 | 5.5% | 0% | 94.5% | 99% | 0.015 |
| Em 4 | 6% | 1% | 93% | 97.5% | 0.021 |
| Comp 1 | 9% | 0% | 91% | 90% | 0.067 |
| Comp 2 | 6% | 1% | 93% | 90% | 0.031 |
| Comp 3 | 5.5% | 0% | 94.5% | 90% | 0.022 |

The high-density polyethylene (HDPE) has a density of 0.943 g/cm$^3$ and a melting point of 125° C., and the low-density polyethylene (LDPE) has a density of 0.924 g/cm$^3$ and a melting point of 113° C. In the exemplary embodiments Em 1 to Em 4, the tungsten carbide powder comprises tungsten monocarbide (WC) of 93 wt % or more, i.e., the purity is equal to or greater than 93 wt %, which is determined by X-Ray Diffraction (XRD) analyses. In an embodiment, flame retardant such as magnesium hydroxide ($Mg(OH)_2$) may be added if desirable. The tungsten carbide powder may be in the shape of debris, polygon, sphere or flake. In an embodiment, the tungsten carbide powder has particle size ranging from 0.01 to 100 μm, and preferably from 0.1 to 50 μm.

In practice, the tungsten carbide powder may comprise high-density polyethylene, medium-density polyethylene, low-density polyethylene, polyvinyl wax, vinyl polymer, polypropylene, polyvinyl chlorine, polyvinyl fluoride, fluorinated polymer, or mixtures thereof.

The manufacturing process of the PTC composition is described as follows. The raw material is fed into a blender (HAAKE 600) at 160° C. for two minutes. The procedure of feeding the raw material includes adding the crystalline polymer with the amounts according to Table 1 into the blender; after blending for a few seconds, then adding the tungsten carbide powder with particle size of 0.1 to 50 μm and flame retardant. The rotational speed of the blender is set at 40 rpm. After blending for three minutes, the rotational speed increases to 70 rpm. After blending for 7 minutes, the mixture in the blender is drained and thereby a conductive composition with PTC characteristic is obtained.

The above conductive composition is loaded symmetrically into a mold with outer steel plates and a 0.33 or 0.2 mm thick middle, wherein the top and the bottom of the mold are disposed with a Teflon cloth. The mold loaded with the conductive composition is pre-pressed for three minutes at 50 kg/cm$^2$ and 180° C. Then the generated gas is exhausted and the mold is pressed for 3 minutes at 100 kg/cm$^2$, 180° C. Next, another press step is performed at 150 kg/cm$^2$ and 180° C. for three minutes to form a PTC material layer 11, as shown in FIG. 1. In an embodiment, the thickness of the PTC material layer 11 is greater than 0.1 mm, or preferably greater than 0.2 mm, such as 0.3 mm or 0.35 mm.

The PTC material layer 11 may be cut into many square pieces each with an area of 20×20 cm$^2$. Then two conductive layers 12, e.g., metal foils, are pressed to physically contact the top surface and the bottom surface of the PTC material layer 11, in which the two conductive layers 12 are symmetrically placed upon the top surface and the bottom surface of the PTC material layer 11. Next, buffers, Teflon cloths and the steel plates are placed on the conductive layers and are pressed to form a multi-layered structure. The multi-layer structure is pressed again at 180° C. and 70 kg/cm$^2$ for three minutes. Next, the multi-layered structure is punched or cut to form over-current protection devices (PTC chips) 10 with an area of 2.8 mm×3.5 mm. In practice, the over-current protection device may be of 2.3 mm×2.3 mm, 2.5 mm×3 mm, or 3 mm×5 mm.

The resistances over-current protection devices 10 are measured, upon which the volume resistivity p of the PTC material layer 11 of each device 10 is calculated in light of the equation (1) below and is recorded in Table 1.

$$\rho = R \times A / L \quad (1);$$

where "R" is the resistance of the over-current protection device 10, "A" is the area of the PTC material layer 11, and "L" is the thickness of the PTC material layer 11.

Em 1 and Comp 1 have the same composition and weight percentage except different purity of tungsten carbide powder. Compared to Comp 1 which uses tungsten carbide powder of a purity of 90 wt % (10 wt % impurity), the volume resistivity of Em 1 which uses tungsten carbide powder of a purity of about 93 wt % (impurity 7 wt %) can decrease by about 25%. Similarly, the volume resistivity of Em 3 using tungsten carbide powder of 99 wt % purity, in comparison with Comp 3 of 90 wt % purity tungsten carbide powder, can be lowered by about 30%.

Table 2 shows the compositions and volume resistivity of Em 5 and Comp 4. Em 5 and Comp 4 have same composition and weight ratio except the different purity of tungsten carbide powder. In comparison with the embodiments in Table 1, Em 5 and Comp 4 comprise relatively large amount of crystalline polymer, in which LDPE is about 3 wt % and tungsten carbide is about 88.2 wt % of the composition. The purity of the tungsten carbide powder of Em 5 is about 94 wt %, whereas the purity of the tungsten carbide powder of Comp 4 is about 89 wt %. It is observed that the volume resistivity of Em 5 is lower than that of Comp 4 by about 50%.

TABLE 2

| | Composition (wt %) | | | Purity of | |
|---|---|---|---|---|---|
| | HDPE | LDPE | Tungsten carbide | tungsten carbide | Resistivity (Ω · cm) |
| Em 5 | 8.8% | 3% | 88.2% | 94% | 0.32 |
| Comp 4 | 8.8% | 3% | 88.2% | 89% | 0.69 |

In practice, the tungsten carbide powder comprises 85-95 wt %, e.g., 88 wt %, 90 wt % or 92 wt %, of the PTC composition. If the purity of the tungsten carbide powder is equal to or greater than 93%, i.e., impurity is equal to or less than 7 wt %, the volume resistivity of the PTC composition can be decreased by about 25-60%.

According to the exemplary embodiments Em 1 to Em 5, the volume resistivity of the PTC is less than 0.4 Ω·cm, or less than 0.3 Ω·cm, 0.2 Ω·cm or 0.1 Ω·cm in particular. If the tungsten carbide powder comprises 91 wt % or more of the PTC composition, the PTC composition has a volume resistivity equal to or less than 0.05 Ω·cm. If the tungsten carbide powder comprises 93 wt % or more of the PTC composition, the PTC composition has a volume resistivity equal to or less than 0.025 Ω·cm. If the tungsten carbide powder comprises 94.5% or more of the PTC composition, the PTC composition has a volume resistivity equal to or less than 0.015 Ω·cm.

Figure 2:
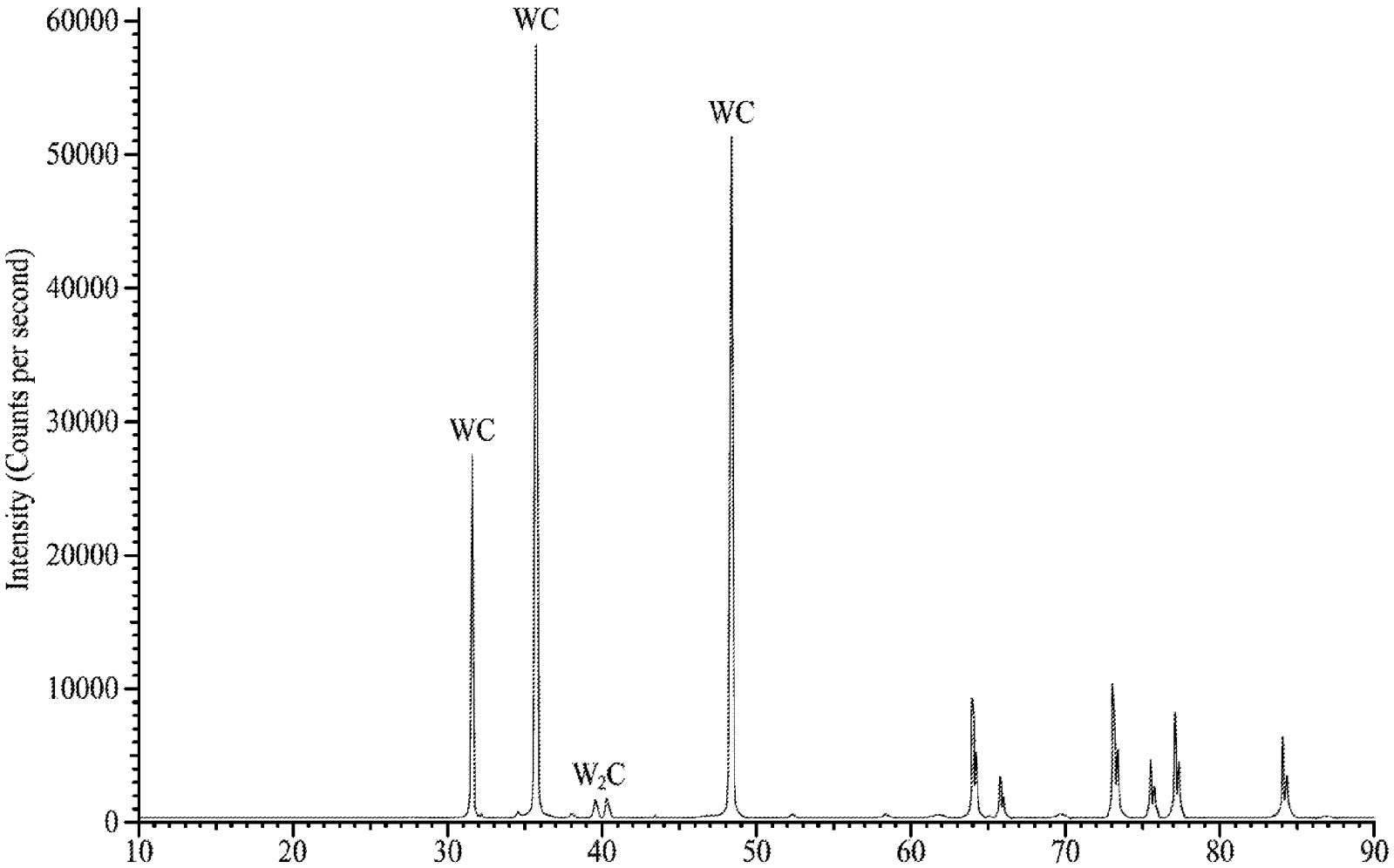
FIGS. 2-5 show XRD diagrams of tungsten carbide powders of various embodiments of the present application and a comparative example.

FIG. 2 shows the XRD diagram of the tungsten carbide powder of Em 3. The weight percentages of tungsten monocarbide (WC) and impurity are calculated according to the XRD diagram. As shown in FIG. 2, three WC representative peaks at scattering angle 2θ of about 31.5, 35.5 and 48.5 degrees and $W_2C$ peak at scattering angle 2θ of about 39.5 degrees are taken into calculation. The small peaks with intensity (counts) less than 1000 are ignored. The counts of the three WC peaks are 28000, 58000 and 51000, and the counts of the $W_2C$ peak is about 1500. Accordingly, the WC weight percentage (purity) of the tungsten carbide powder is calculated (28000+58000+51000)/(28000+58000+51000+1500)=99%, and $W_2C$ weight percentage of the tungsten carbide powder is 1500/(28000+58000+51000+1500)=1%.

Figure 3:
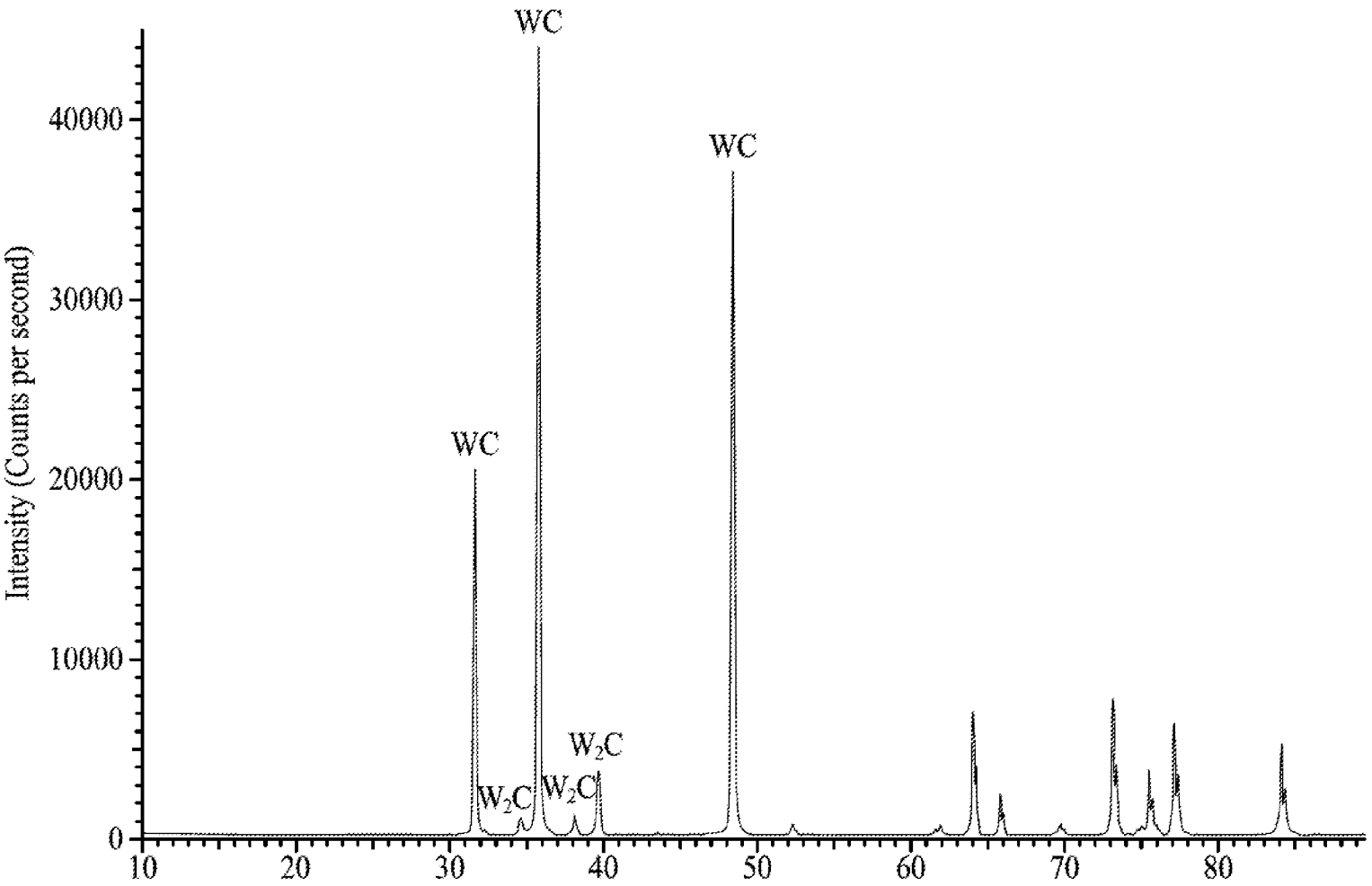

FIG. 3 shows XRD diagram of the tungsten carbide powder of Em 2. Likewise, three WC representative peaks at scattering angle 2θ of about 31.5, 35.5 and 48.5 degrees and $W_2C$ peak at scattering angle 2θ of about 34.5, 38 and 39.5 degrees are taken into calculation. The small peaks with counts less than 1000 are ignored. The counts of the three WC peaks are 20500, 44000 and 37000, and thus the sum is 101500. The counts of the $W_2C$ peaks are about 1000, 1100 and 3500, and the sum is 5600. Accordingly, the WC weight percentage (purity) of the tungsten carbide powder is (101500)/(101500+5600)=94.8% (approximately 95%), and $W_2C$ weight percentage of the tungsten carbide powder is 5600/(101500+5600)=5.2%. In practice, the impurity of $W_2C$ has to be less than 7%, preferably less than 5% or 3%, and most preferably less than 1%. It is observed that the amount of $W_2C$ is sensitive to the volume resistivity. According to test results, the volume resistivity of the PTC composition can decrease effectively if the weight percentage of $W_2C$ can be controlled to less than 3%, or preferably less than 1%.

Figure 4:
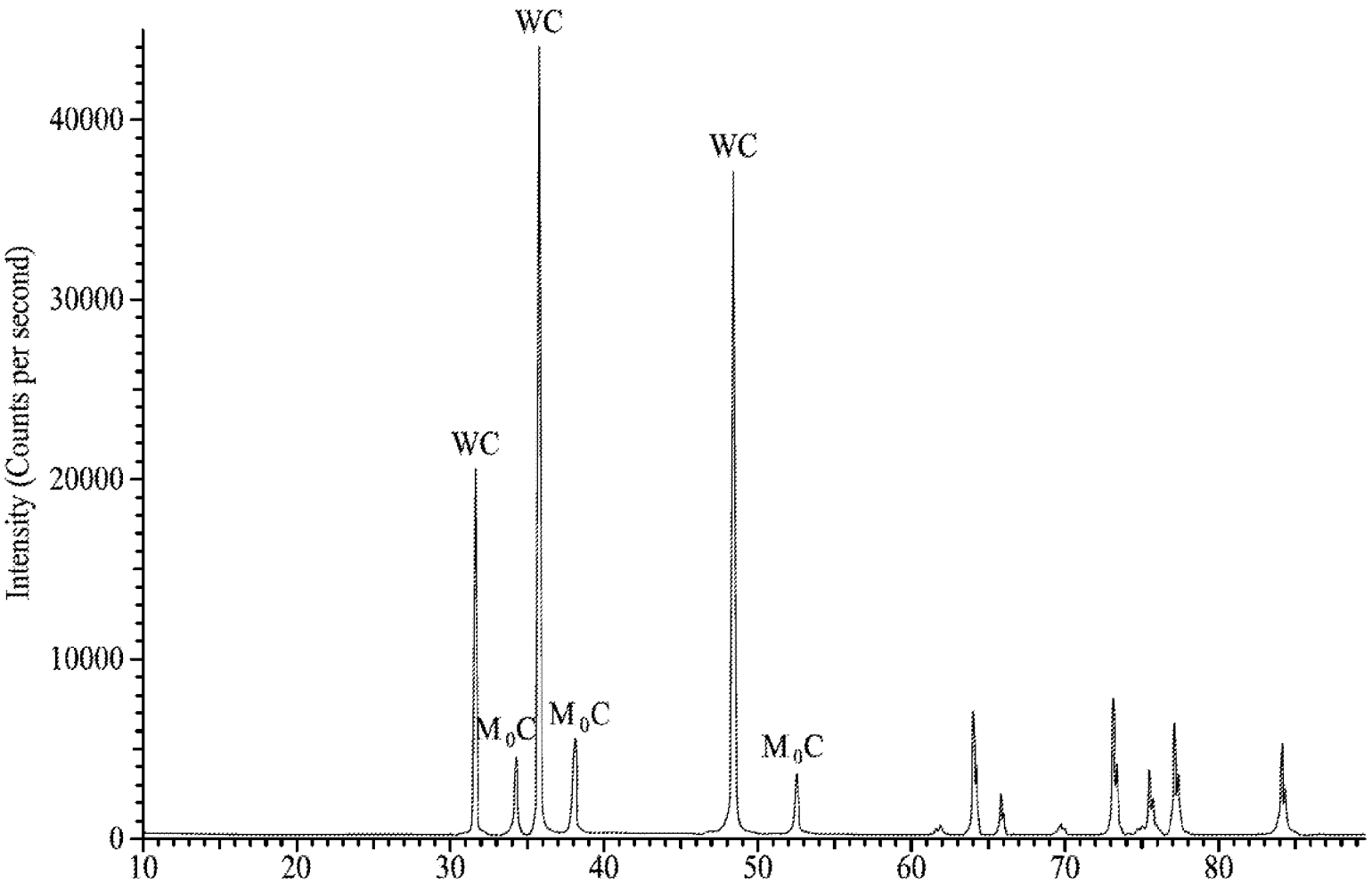

FIG. 4 shows XRD diagram of the tungsten carbide powder of Comp 4. Three WC representative peaks at scattering angle 2θ of about 31.5, 35.5 and 48.5 degrees and molybdenum carbide (MoC) peaks at scattering angle 2θ of about 34, 38 and 52.5 degrees are taken into calculation. Accordingly, the WC weight percentage (purity) of the tungsten carbide powder is calculated to be about 89%, and MoC weight percentage of the tungsten carbide powder is about 11%. In practice, the impurity of MoC has to be less than 7%, preferably less than 5% or 3%. Em 5 and Comp 4 have the same composition and weight percentage; however the WC purity of tungsten carbide of Comp 4 is only 89%, and therefore the PTC composition of Comp 4 has higher volume resistivity than the PTC composition of Em 5.

Figure 5:
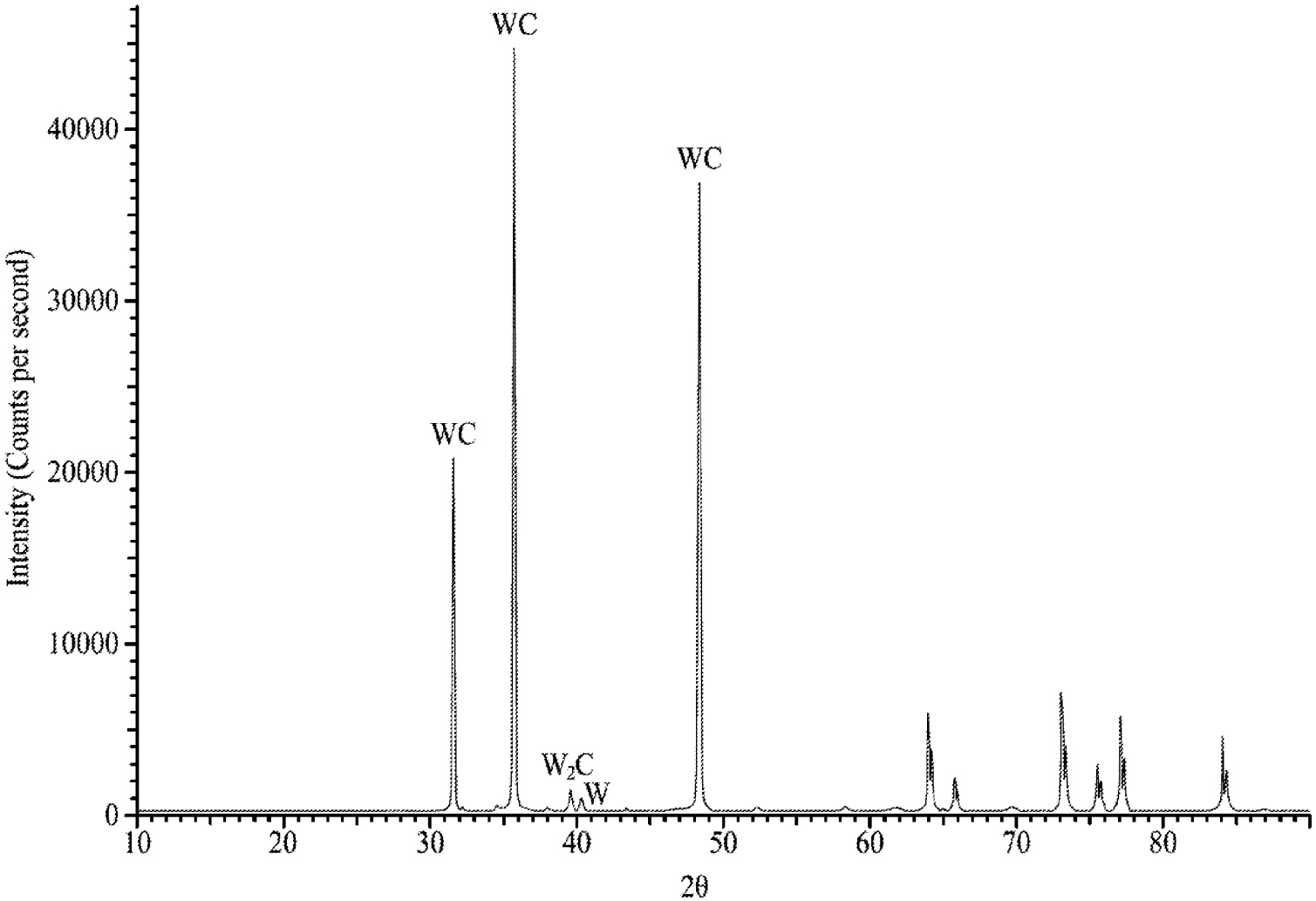

FIG. 5 shows XRD diagram of the tungsten carbide powder of Em 4. Three WC representative peaks at scattering angle 2θ of about 31.5, 35.5 and 48.5 degrees, a $W_2C$ peak at scattering angle 2θ of about 39.5 degrees and W representative peak at scattering angle 2θ of about 40.3 degrees are taken into calculation. Accordingly, the WC weight percentage (purity) of the tungsten carbide powder is calculated to be about 97.5%, $W_2C$ weight percentage is about 1.5%, and $W_2C$ weight percentage is about 1%.

In summary, the calculation of the purity of tungsten carbide is based upon the peaks at scattering angle 2θ less than 60 degrees in which the calculation for tungsten monocarbide (WC) is based upon three peaks with large count numbers and the calculation for impurities other than WC is based upon one to three peaks with large counts. The intensity or counts less than 1000 are not taken into consideration. The purity and weight percentage of impurity of the tungsten carbide powder are calculated on a basis of the count number of the peaks.

The PTC material layer 11 may use crystalline polyolefines (e.g., high-density polyethylene (HDPE), medium-density polyethylene, low-density polyethylene (LDPE), polyvinyl wax, vinyl polymer, polypropylene, polyvinyl chlorine and polyvinyl fluoride), copolymer of olefin monomer and acrylic monomer (e.g., copolymer of ethylene and acrylic acid or copolymer of ethylene and acrylic resin) or copolymer of olefin monomer and vinyl alcohol monomer (e.g., copolymer of ethylene and vinyl alcohol), and may include one or more crystalline polymer materials. The LDPE can be polymerized using Ziegler-Natta catalyst, Metallocene catalyst or the like, or can be copolymerized by vinyl monomer and other monomers such as butane, hexane, octane, acrylic acid, or vinyl acetate.

In an embodiment, two metal leads may be jointed to the two conductive layers of the over-current protection device by solder paste (reflow process) to form an assembly of an axial-leaded over-current protection device. In practice, the PTC composition or the over-current protection device can be modified to radial-leaded, terminal or surface mount device if desired.

A test of resistance repeatability undergoes by applying a voltage of 6V and a current of 50 A to the over-current protection devices. The ratio R300/Ri is less than 25 or 20 and R100/Ri is less than 18 or 15, where R300 is the resistance after tripping 300 times, R100 is the resistance after tripping 100 times, and Ri is initial resistance of the over-current protection device. It is noted that the over-current protection device using high purity tungsten carbide powder can perform superior resistance repeatability.

The volume resistivity of the PTC material layer can be lowered by using high purity tungsten carbide powder as conductive filler, and therefore the over-current protection device containing the PTC material layer can exhibit lower resistance. In contrast, the weight percentages of impurities such as $W_2C$ or MoC should be decreased as much as possible to ensure low volume resistivity.

The above-described embodiments of the present invention are intended to be illustrative only. Numerous alternative embodiments may be devised by persons skilled in the art without departing from the scope of the following claims.

What is claimed is:

1. A PTC composition, comprising:

a crystalline polymer;

a conductive filler comprising tungsten carbide powder dispersed in the crystalline polymer;

wherein the tungsten carbide powder comprises impurity that is equal to or less than 7 wt % of the tungsten carbide powder and is generated during formation of the tungsten carbide powder by sintering, and the impurity comprises materials other than tungsten monocarbide having molecular formula WC.

2. The PTC composition of claim 1, wherein the PTC composition has a volume resistivity less than 0.4 Ω·cm.

3. The PTC composition of claim 1, wherein the tungsten carbide powder comprises 85-95 wt % of the PTC composition.

4. The PTC composition of claim 1, wherein the tungsten carbide powder comprises at least 91 wt % of the PTC composition, and the PTC composition has a volume resistivity equal to or less than 0.05 Ω·cm.

5. The PTC composition of claim 1, wherein the tungsten carbide powder comprises at least 93 wt % of the PTC composition, and the PTC composition has a volume resistivity equal to or less than 0.025 Ω·cm.

6. The PTC composition of claim 1, wherein the tungsten carbide powder comprises at least 94.5 wt % of the PTC composition, and the PTC composition has a volume resistivity equal to or less than 0.015 Ω·cm.

7. The PTC composition of claim 1, wherein the tungsten monocarbide is of hexagonal close-packed structure.

8. The PTC composition of claim 1, wherein the impurity of the tungsten carbide powder comprises carbon, oxygen, tungsten oxide, tungsten, cobalt, nickel, chromium, molybdenum, iron, zirconium carbide, molybdenum carbide, tungsten carbide with molecular formula $W_2C$, tungsten carbide with molecular formula $WC_{1-x}$, or combinations thereof.

9. The PTC composition of claim 1, wherein the impurity $W_2C$ is present and less than 3 wt % of the tungsten carbide powder.

10. The PTC composition of claim 1, wherein the crystalline polymer comprises high-density polyethylene, medium-density polyethylene, low-density polyethylene, polyvinyl wax, vinyl polymer, polypropylene, polyvinyl chlorine, polyvinyl fluoride, fluorinated polymer, or mixture thereof.

11. An over-current protection device, comprising:

two conductive layers;

a PTC material layer laminated between the two conductive layers, the PTC material layer comprising the PTC composition as recited in claim 1.

12. The over-current protection device of claim 11, wherein the conductive layers are copper foils, nickel foils or nickel-plated copper foils.

13. The PTC composition of claim 1, wherein a weight percentage of the impurity is calculated according to its intensity in an XRD diagram of the tungsten carbide powder.

* * * * *